United States Patent [19]

Dendinger

[11] 4,106,743

[45] Aug. 15, 1978

[54] ADJUSTABLE BULKHEAD FOR CONCRETE WALL FORMS

[76] Inventor: Dennis W. Dendinger, R.R. #1, Hartington, Nebr. 68739

[21] Appl. No.: 845,873

[22] Filed: Oct. 27, 1977

[51] Int. Cl.[2] ..... E04G 11/06

[52] U.S. Cl. ..... 249/34; 249/21; 249/97; 249/188

[58] Field of Search ..... 249/19, 21, 33, 34, 249/97, 188

[56] References Cited

U.S. PATENT DOCUMENTS

| | | | |
|---|---|---|---|
| 2,556,928 | 6/1951 | Ludlow | 249/97 |
| 3,731,902 | 5/1973 | Shoemaker | 249/33 |
| 3,833,199 | 9/1974 | Frake | 249/33 |

*Primary Examiner*—Francis S. Husar
*Assistant Examiner*—John McQuade
*Attorney, Agent, or Firm*—Zarley, McKee, Thomte, Voorhees & Sease

[57] ABSTRACT

The adjustable bulkhead comprises a pair of vertically disposed and horizontally spaced angle members which are supported on a plurality of vertically spaced tie bars which extend horizontally between the ends of a pair of spaced-apart concrete forms. An elongated channel member is selectively horizontally adjustably mounted on each of the channel members. The lateral adjustability of the channels with respect to the angles permits a bulkhead to be formed between the ends of the concrete forms irrespective of the varying distances between the forms.

6 Claims, 5 Drawing Figures

ADJUSTABLE BULKHEAD FOR CONCRETE WALL FORMS

BACKGROUND OF THE INVENTION

This invention relates to an adjustable bulkhead for concrete forms and more particularly to an adjustable bulkhead which will accommodate reinforcing rods or bars extending therethrough.

Extremely long concrete walls are frequently poured in successive sections. In other words, if the wall is 100 feet long, the length of the wall may be completed in two or three pours. Initially, a predetermined length of wall forming will be built with the ends of the forms being closed. Heretofore, the ends of the forms were closed with lumber or the like nailed to the forms. Prior to the lumber being nailed to the forms, holes must be drilled in the lumber to accommodate the horizontally extending reinforcing bars positioned between the forms. The horizontally extending reinforcing bars must extend through the bulkhead or the end of the forms so that the bars may be connected to the horizontal reinforcing bars which will be positioned in the wall adjacent to the wall being poured. After the concrete has been poured between the forms, the concrete is allowed to harden and the wooden bulkhead is stripped from the forms. The concrete forms are then stripped from the concrete wall which has hardened and they are moved horizontally for the next pour where the procedure is again repeated.

The wooden or lumber bulkheads are not only difficult to position between the ends of the forms but are difficult to remove from the hardened concrete. It is practically impossible to remove the wooden bulkheads from the concrete and forms without damaging the same.

Therefore, it is a principal object of the invention to provide an adjustable bulkhead for concrete forms.

A still further object of the invention is to provide an adjustable bulkhead for concrete forms which permit reinforcing rods or bars to extend therethrough.

A still further object of the invention is to provide an adjustable bulkhead for concrete forms which is easily mounted on the forms.

A still further object of the invention is to provide an adjustable bulkhead for concrete forms which permits water seals to be positioned in the concrete.

A still further object of the invention is to provide an adjustable bulkhead for concrete forms which results in an irregular configuration of the concrete which will satisfactorily tie into the next wall section.

A still further object of the invention is to provide an adjustable bulkhead for concrete forms which will accommodate various width forms.

A still further object of the invention is to provide an adjustable bulkhead for concrete forms which is economical of manufacture, durable in use and refined in appearance.

These and other objects will be apparent to those skilled in the art.

DESCRIPTION OF THE PREFERRED INVENTION

Figure 1:
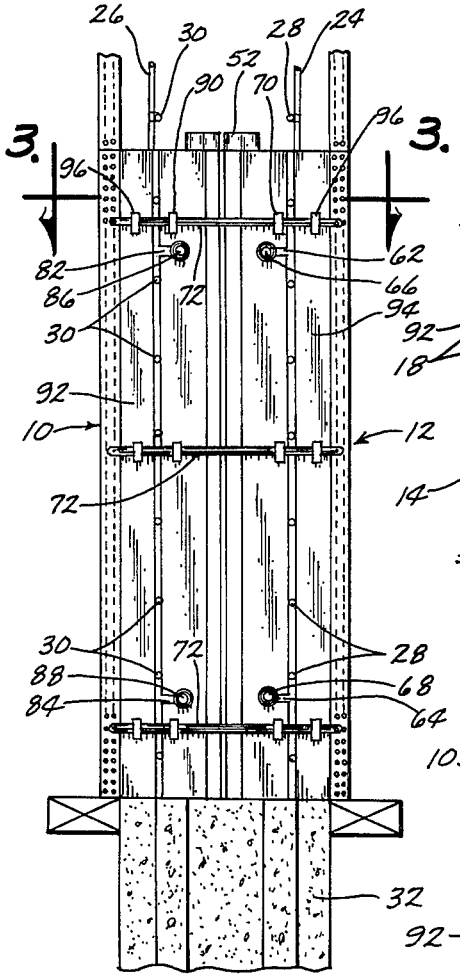
FIG. 1 is an end view of the adjustable bulkhead of this invention extending between wall forms positioned on a concrete footing.

The numerals 10 and 12 refer to conventional concrete forms having vertically disposed flanged ends 14 and 16 respectively which are provided with openings 18 and 20 respectively. For purposes of description, the drawings show poured concrete having vertical reinforcing rods or bars (re-bars) 24 and 26 and horizontal reinforcing rods or bars (re-bars) 28 and 30. The bars 24 and 26 extend upwardly from footings 32 or from a lower wall section.

The adjustable bulkhead assembly is referred to generally by the reference numeral 34. Bulkhead 34 includes upstanding channels 36 and 38 which have their open ends positioned away from the concrete to be poured between the forms 10 and 12. Channel 36 has a plurality of vertically spaced horizontal rods 40 extending between the sides 42 and 44 thereof. Channel 38 has a plurality of vertically spaced horizontal rods 46 extending between the sides 48 and 50 thereof. The upper ends of channels 36 and 38 are each closed by means of a cap 52 which prevents concrete from falling downwardly into the channels.

Figure 2:
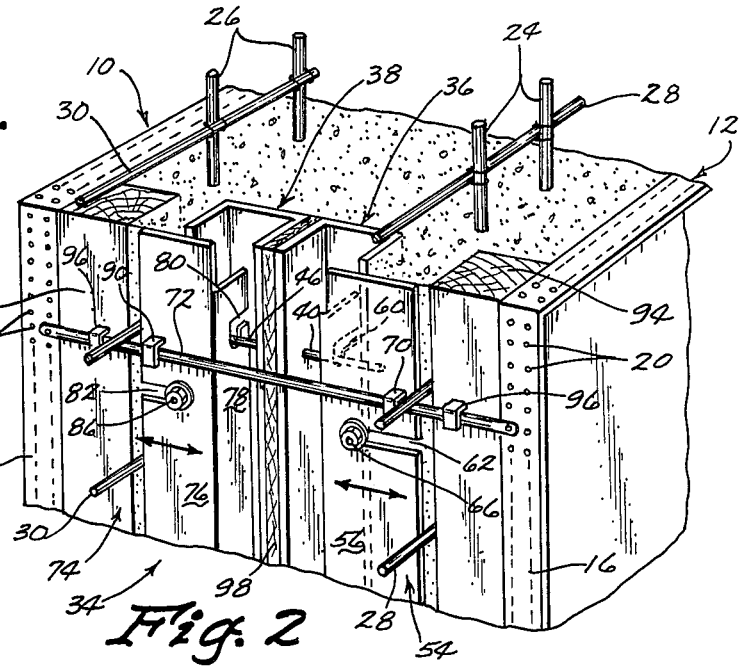
FIG. 2 is a partial perspective view of the upper end portion of the bulkhead in an installed position.
Figure 3:
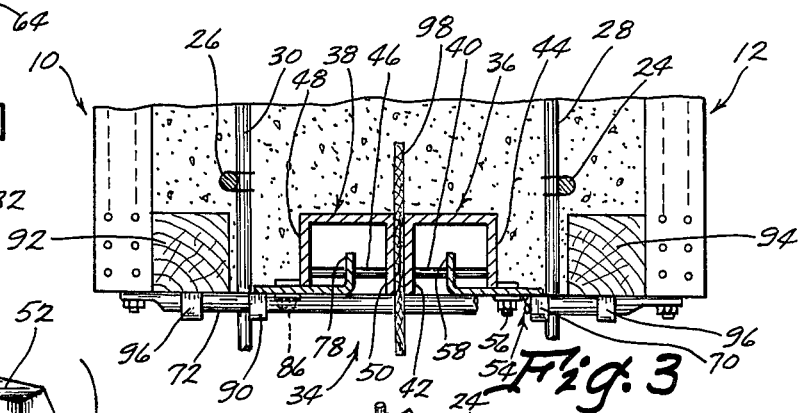
FIG. 3 is an enlarged sectional view seen on lines 3—3 of FIG. 1.
Figure 4:
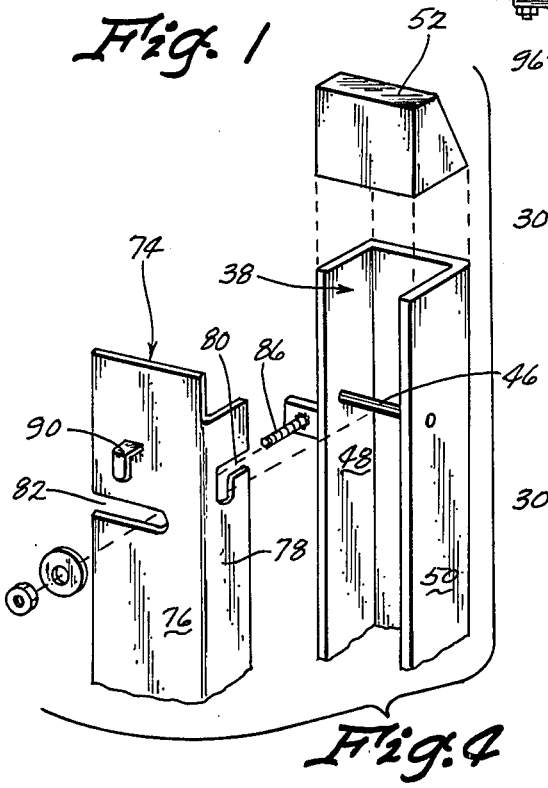
FIG. 4 is a partial exploded perspective view of a portion of the invention.

Angle 54 is adjustably secured to channel 36 and includes walls 56 and 58. Wall 58 is provided with vertically spaced slots 60 which are adapted to receive the rods 40. As seen in FIG. 2, the inner ends of the slots 60 terminate the downwardly extending portions which serve to limit relative movement between wall 58 and rods 40. Wall 56 of angle 54 has a pair of horizontally extending slots 62 and 64 formed therein which are adapted to receive bolts 66 and 68 extending outwardly therethrough. Bolts 66 and 68 are secured to channel 36 at the outer forward portion of side 44. Clips 70 are positioned on the wall 56 and are designed to receive tie bar 72 as illustrated in FIG. 2. A plurality of tie bars 72 are secured to openings 18 and 20 in forms 10 and 12 respectively in a manner illustrated in FIG. 1.

Angle 74 is adjustably secured to channel 38 and includes walls 76 and 78. Wall 78 is provided with vertically spaced slots 80 which are adapted to receive the rods 46. As seen in FIG. 2, the inner ends of the slots 80 terminate in downwardly extending portions which serve to limit relative movement between wall 78 and rods 46. Wall 76 of angle 74 has a pair of horizontally extending slots 82 and 84 formed therein which are adapted to receive bolts 86 and 88 extending outwardly therethrough. Bolts 86 and 88 extending outwardly therethrough. Bolts 86 and 88 are secured to channel 38 at the outer forward portion of side 48. Clips 90 are positioned on wall 76 of angle 74 and are designed to receive tie bar 72 as illustrated in FIG. 2.

As previously stated, the forms 10 and 12 are mounted on the footings 32 in conventional fashion. The reinforcing bars 24, 26, 28 and 30 are positioned between the forms 10 and 12 with the bars 28 and 30 extending outwardly beyond the ends of the forms 10 and 12 so that the bars may be tied into the next wall section which will be poured after the section being formed.

The nuts on bolts 66 and 68 are then loosened to permit angle 54 to be loosely mounted on the bolts 62 and 64. The channel 36 and angle 54 are then positioned at the end of the form so that wall 56 is approximately flush with end 16. Angle 34 and channel 38 are then similarly positioned between the forms as illustrated. As seen in FIG. 2, the bulkhead is positioned between the reinforcing bars 28 and 30. Elongated wooden members 92 and 94 are then positioned adjacent the inside surfaces of forms 10 and 12 at the ends thereof as seen in FIG. 2. Tie bars 72 are then secured to ends 14 and 16 of forms 10 and 12 as illustrated in FIG. 1. Members 92 and 94 are secured to the tie bars 72 by means of clips or staples 96. Angles 34 and 54 are removably mounted on the tie bars 72 by means of the clips 90 and 96 which prevents inward or outward movement of the angles 34 and 54 relative to the form. If desired, a water seal may be positioned between the channels 36 and 38 so that the inner end thereof will extend inwardly into the concrete being formed and so that the outer end thereof will extend outwardly beyond the channels for positioning in the next wall section. Channels 36 and 38 are slideably moved inwardly for engagement with the water seal 98 and the angles 34 and 54 are slideably moved outwardly until the outer edges thereof engage the bars 30 and 28 respectively. The nuts on the bolts 66, 68, 86 and 88 are then tightened to maintain the adjustable bulkhead in position. Although there is a slight gap between the outer side edges of angles 34 and 54 with respect to the elongated members 92 and 94, the consistency of concrete employed in walls is sufficient to prevent the concrete from oozing outwardly therebetween.

Figure 5:
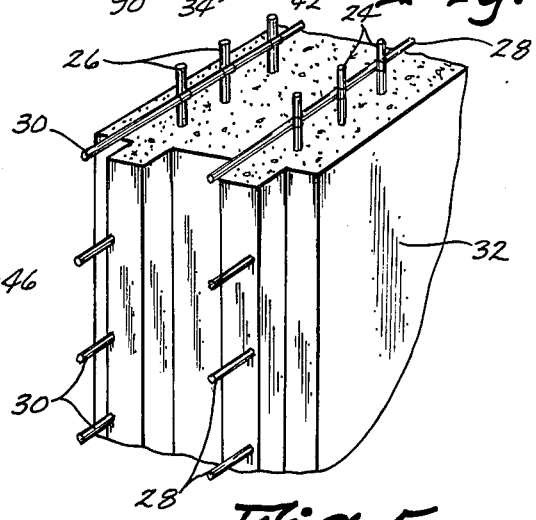
FIG. 5 is a partial perspective view of the upper portion of the resultant concrete wall.

The concrete is then poured between the forms and allowed to harden. After the concrete has sufficiently cured, tie bars 72 are removed from the ends of the forms. The nuts on the bolts 66, 68, 86 and 88 are then preferably loosened with the adjustable bulkhead then being pried outwardly or removed from the hardened concrete. Elongated members 92 and 94 are then also removed from the concrete. Forms 10 and 12 may then be removed. If desired, the forms 10 and 12 may be removed prior to removing the adjustable bulkhead and members 92 and 94. After the bulkhead and forms have been removed from the hardened concrete, the wall will present the configuration which is illustrated in FIG. 5. FIG. 5 does not illustrate a water seal being employed but it should be understood that the same may be employed as desired. The irregular configuration provided in the end of the concrete wall ensures that the next concrete wall section will "interlock" with the previously formed wall so that sufficient strength is achieved.

Thus it can be seen that an adjustable bulkhead has been provided which will accommodate various wall thicknesses. It can also be seen that the adjustable bulkhead is easy to use and will result in substantial savings in labor and materials. Thus it can be seen that the invention accomplishes at least all of its stated objectives.

I claim:

1. In combination, first and second vertically disposed and horizontally spaced form members having end portions and inner and outer wall surfaces, a plurality of reinforcing bars positioned between said form members including a plurality of first vertically spaced and horizontally disposed bars extending outwardly beyond the end portions of said form members, and a plurality of second vertically spaced and horizontally disposed bars extending outwardly beyond the end portions of said form members, a plurality of vertically spaced tie bars secured to the end portions of said first and second form members and extending therebetween, a first vertically disposed elongated member positioned at the inner wall surface of said first form member adjacent the end portion thereof, a second vertically disposed elongated member positioned at the inner wall surface of said second form member adjacent the end portion thereof, connection means securing said first and second elongated members to said tie bars, first and second vertically disposed angle members mounted on said tie bars adjacent said first and second elongated members respectively, first and second vertically disposed channel members secured to said first and second angle members, second connection means horizontally adjustably securing together said first channel member and said first angle member, third connection means horizontally adjustably securing together said second channel member and said second angle member, said second and third connection means permitting relative horizontal movement between said first and second channel members and said first and second angle members respectively to provide an adjustable bulkhead for concrete placed between said form members, said first reinforcing bars extending outwardly beyond said first form member between said first elongated member and said first angle member, said second reinforcing bars extending outwardly beyond said second form member between said second elongated member and said second angle member.

2. The combination of claim 1 wherein said channel members are removably secured to said angle members.

3. The combination of claim 1 wherein each of said channel members include horizontally extending and vertically spaced supports secured thereto, said angle members being removably reclined on said supports.

4. The combination of claim 1 wherein a water seal is positioned between said channel members.

5. The combination of claim 1 wherein said channel members are disposed horizontally with respect to said angle members to create an irregular end portion in the concrete being positioned between said form members.

6. The combination of claim 1 wherein the upper ends of said channel members are closed.

* * * * *